United States Patent [19]

Scherer

[11] 4,241,772

[45] Dec. 30, 1980

[54] SAWBUCK

[76] Inventor: Fred F. Scherer, Frendship, Me. 04547

[21] Appl. No.: 936,014

[22] Filed: Aug. 23, 1978

[51] Int. Cl.[3] ..... B25H 1/06

[52] U.S. Cl. ..... 269/289 R; 182/181; 248/176; 269/909; 269/329; 269/315

[58] Field of Search ..... 17/44; 248/127, 176; 182/181, 186; 269/296, 321 N; 144/286 R, 286 A, 288 R, 288 C

[56] References Cited

U.S. PATENT DOCUMENTS

| | | | |
|---|---|---|---|
| 1,798,340 | 3/1931 | Thewes | 269/296 |
| 2,440,847 | 5/1948 | Charley | 182/181 |
| 2,652,079 | 9/1953 | Worthen | 144/288 R |
| 2,709,384 | 5/1955 | Harris | 248/176 X |

FOREIGN PATENT DOCUMENTS

| | | | |
|---|---|---|---|
| 918705 | 8/1954 | Fed. Rep. of Germany | 144/288 R |
| 22843 | 4/1948 | Finland | 144/288 R |

*Primary Examiner*—W. Donald Bray

[57] ABSTRACT

A sawbuck has a base in support of a log holder having transverse, horizontal receivers of different sizes which establish a size range such that the end of a log or split section thereof within a substantial range of cross sectional dimensions may be entered in and held by the appropriate one of the receivers as a cantilever and then cut into wanted lengths.

9 Claims, 6 Drawing Figures

SAWBUCK

BACKGROUND REFERENCE

U.S. Pat. No. 2,440,847

BACKGROUND OF THE INVENTION

The increasing use of wood as a fuel in homes presents problems to the consumer in that it is most economical to buy cord wood. Such wood, being conventionally four feet in length, and of course longer logs, must be cut, typically in twelve or sixteen inch lengths, and in two foot lengths for some heaters, and then split, if necessary, into sizes appropriate for burning when sufficiently dry.

The usual sawbucks, commonly called saw horses, support a log so that it may be cut in two but if used in sawing cordwood that is to be cut in thirds or quarters, the log will tip once a section has been cut free, requiring it to be again lifted and centered on the sawbuck. This problem has been recognized and sometimes a log holder will be home made with a support of appropriate length provided with a lengthwise series of holders to prevent the log to be cut from rolling off as it is sawed. A sawbuck of this type is not adapted for commercial production and, in addition to its bulk and the fact that it does not prevent binding, has the disadvantage that, particularly when a chain saw is used, the support on which the log rests unavoidably becomes cut which is also the case with commercially available sawbucks.

THE PRESENT INVENTION

The general objective of the present invention is to provide sawbucks that overcome the difficulties now experienced in sawing cord wood into wanted lengths with chain saws.

In accordance with the invention, this objective is attained with a sawbuck having a base to which log holding means are connected by a vertical support. The log holding means has transverse, horizontal receivers, each of a different size and together enabling the ends of logs and split sections thereof within a substantial range of cross sectional dimensions to be entered in and be held by the appropriate one of said receivers, thus enabling a log and split sections thereof to be held as a cantilever and cut into wanted lengths.

Another objective of the invention is to provide log holding means that are adapted to meet low cost manufacturing requirements, an objective attained with the log holding means in the form of two jaws at least one and preferably both of which have recesses for log ends. Preferably the receivers are V-shaped and they may be formed in a metal member and notched to provide anchoring points and the metal member may be a jaw or a part of a composite jaw. The vertical dimensions of the recesses are established preferably by disposing the jaws so that they diverge vertically with a minimum spacing adjacent one side of the base and a maximum adjacent the other side thereof. An important additional feature is that the jaws are relatively thin with the upper jaw spaced rearwardly of the lower jaw with respect to the direction in which a log is to be entered into a receiver.

Yet another objective of the invention is to provide means connecting the log holding means to the base that are also adapted to meet manufacturing requirements, an objective attained with the connecting means having two side supports each of which has two uprights interconnected at their upper ends and separately connected at their lower ends to the base. The lower jaw is carried by the first uprights and the upper jaw by the other uprights.

Yet another objective of the invention is to provide a construction that can be easily assembled and also folded for storage, an objective attained with a base having two side members to the insides of one end of each of which the lower ends of the uprights are separately bolted. With the bolts removed that hold the second uprights to which the lower jaw is secured, the side supports may be swung downwardly with the first upright between the side members of the base. This feature also permits the connecting means to be reversed and logs or split sections thereof to be inserted in the log holding means in the opposite direction and held away from the base. For such use, the base must be temporarily counterweighted.

BRIEF DESCRIPTION OF THE DRAWINGS

The accompanying drawings illustrate a preferred embodiment of the invention with FIG. 1 a front perspective view of a sawbuck in accordance with the invention.

THE PREFERRED EMBODIMENT OF THE INVENTION

Figure 1:
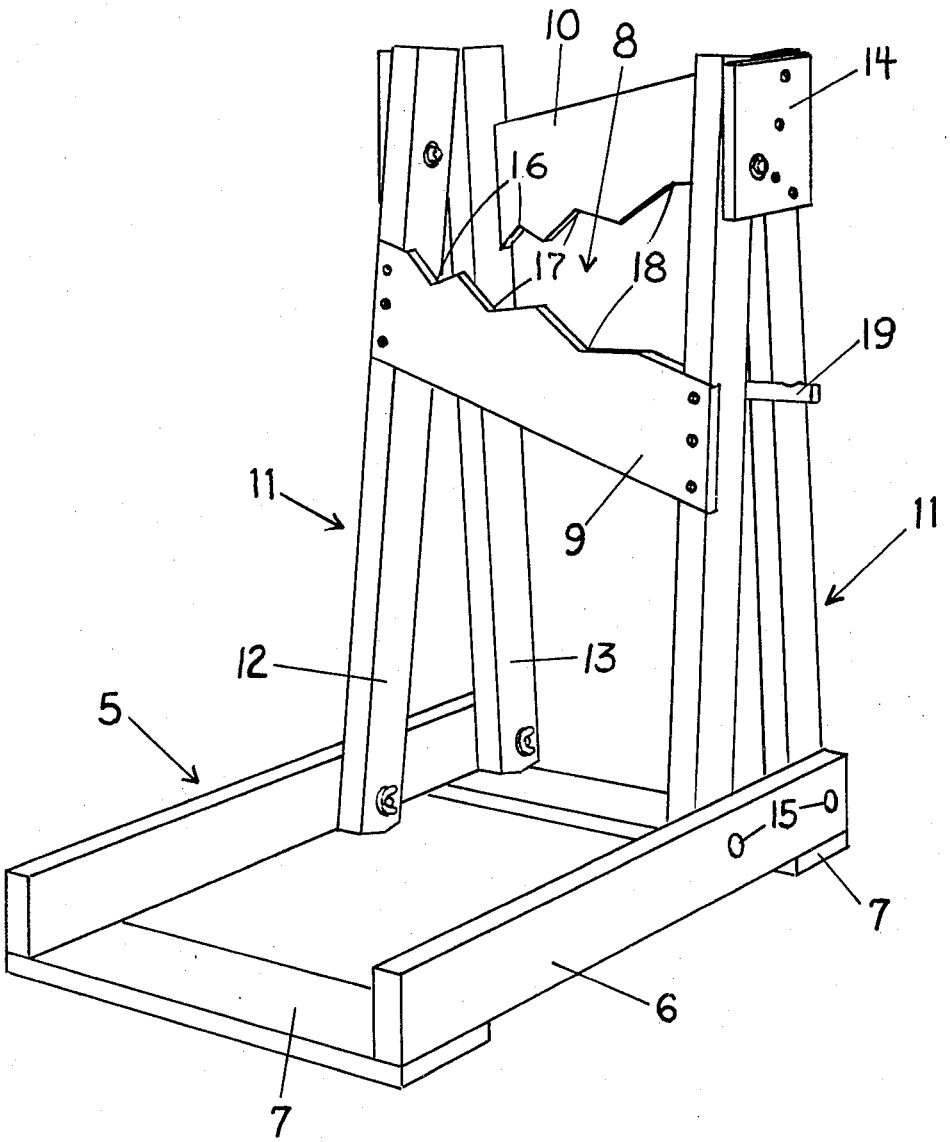
Figure 2:
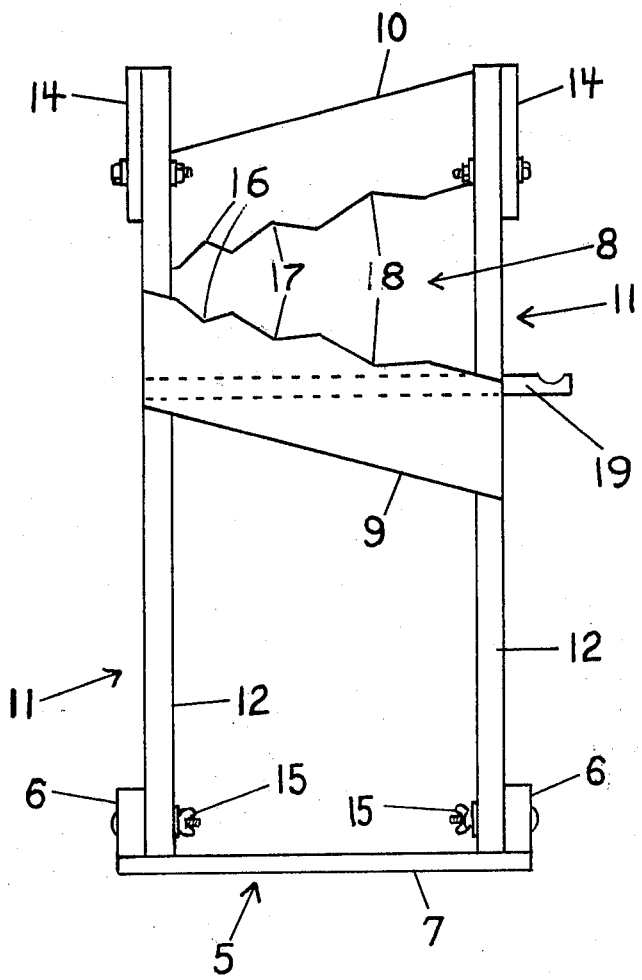
FIG. 2 a side view of the sawbuck.
Figure 3:
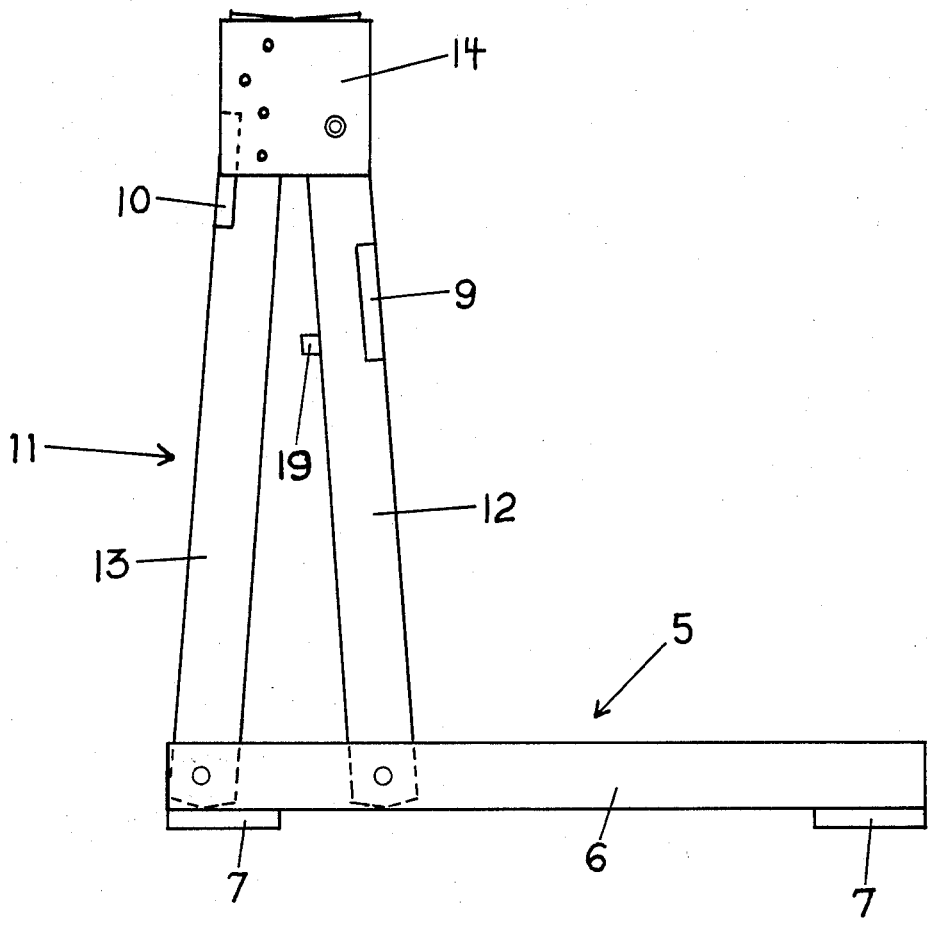
FIG. 3 a front view thereof.

The embodiment of the invention illustrated by the drawings has a base, generally indicated at 5 and formed by two side members 6 joined at their ends by underlying connecting members 7.

The log holding means, generally indicated at 8, are shown as a first or lower jaw 9 and a second or upper jaw 10. The log holding means 8 are connected to the base 5 by side supports, generally indicated at 11, the side supports and the log holding means constituting a stand. It is preferred that the base and the side members be made of wood.

Each side support has first and second uprights 12 and 13, respectively, connected at their upper ends by a tie 14, in practice of hardwood plywood. The lower end of each upright is connected by bolts 15 to the inner surface of the appropriate side member 6 of the base 5 adjacent the rear end thereof with the uprights 13 rearwardly of the uprights 12. The uprights 12 and 13 are shown as inclined slightly upwardly towards each other and in practice are of so-called two by four stock. The lower jaw 9 is inset in and secured to the front faces of the uprights 13. The proximate edges of the jaws are inclined away from each other to establish an opening that increases in height from a minimum adjacent one side support 11 to a maximum adjacent the other side support.

The jaws 9 and 10 may be formed from one by six inch stock ensuring that the stand is rigid and, in practice, their proximate sides are spaced preferably about eight to ten inches apart. The width of the supports 11 is such that a log or split section thereof may be supported by the lower jaw 9 and held close to its supported end by the upper jaw 10 to enable the last cut to be a foot from that end with the path of the saw a safe distance forwardly of the uprights 12 even if the held end projects, a short distance, say two inches, rearwardly of the jaw 10.

The proximate edges of the jaws 9 and 10 are formed with a series of abutting, receiver-deforming recesses 16, 17, and 18, preferably and as shown in the form of shallow V's which may be of the same or approximately the same depth. The width of the recess 17 is greater than that of the recess 16 but less than that of the recess 18. By way of example but not of limitation, with the angle defined by the proximate edges of the jaws in the neighborhood of 28°, the depth of the recesses about one inch, and the width of the recesses 16, 17, and 18, about three, five, and six inches, respectively, an end of logs ranging in diameter from three to ten inches and split log sections having cross sectional dimensions within that range can be entered in and held by an appropriate one of the receivers defined by the vertically aligned recesses 16, 17, and 18. Split logs are held in the same manner if their cross sectional areas are within the predetermined size range except in the case of large logs split in half. For example, a log a foot in diameter when split in two results in sections having a width dimension such that a half log may be supported by portions of two adjacent recesses of at least one jaw or by the ridges at their junctions and often by two such junctions of the lower jaw and one junction of the upper jaw as usually such wood is sawed, bark side up. With the base about three and one-half feet in length, logs and split sections thereof as much as eight feet in length may be held as cantilevers. With the side supports 11 dimensioned to position the jaws so that the wood to be sawed is about two and one-half feet above the ground, it may be cut into wanted lengths with maximum ease and convenience with some of the cut lengths falling on the side members 6 of the base 5.

If it is desired to prevent the cut lengths from hitting the side members 6, the bolts 15 can be removed, the stand reversed, and the bolts 15 then replaced. Logs and split sections thereof can then be entered in the opposite direction and held by the receivers provided the base 5 is counterweighted.

While usually the sawbuck may be stored, ready for use, it may be folded for storage purposes. With the bolts 15 holding the uprights 13 removed, the stand may be swung forwardly to bring the uprights 12 against the connecting member 7 at the other end of the base 5.

A hanger 19 is secured to the inner edges of the uprights 12 and protrudes from one side of the stand to enable a chain saw to be hung thereon with its blade extending into the spaces between the uprights 12 and 13 so that it may be safely supported, with its engine running, in a position in which, when another log or split section thereof is held by one end in the appropriate receiver, it can be quickly removed and put to use.

Figure 5:
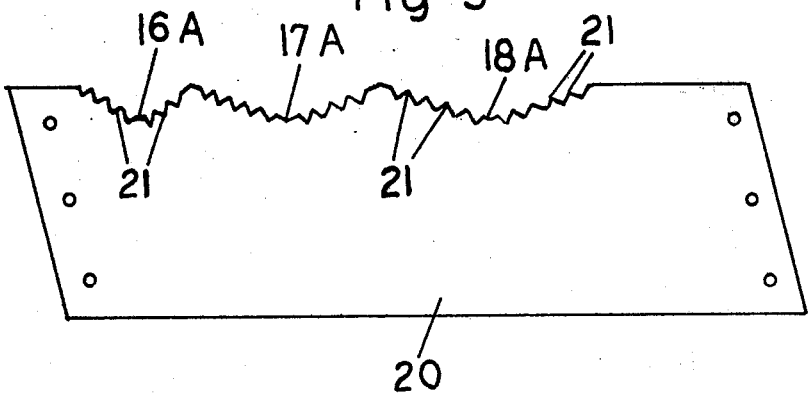
FIG. 5 is a like view of a metal jaw.
Figure 4:
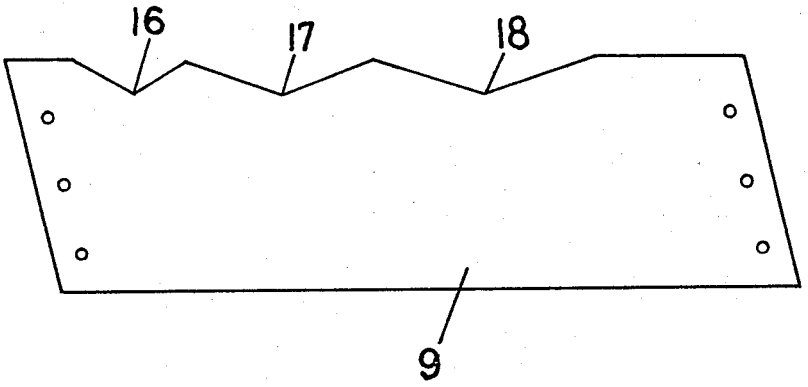
FIG. 4 is a face view, on an increase in scale, of one of the wood jaws.

In FIG. 5, a metal jaw 19 is shown which may be used as an upper jaw, a lower jaw or as both. The jaw 19 has its V-shaped recesses 16A, 17A, and 18A, desirably and as shown, of approximately the same dimensions as the corresponding V-shaped recesses 16, 17, and 18. The sides of each recess have a series of notches providing anchoring points 21 ensuring that a log or split sections thereof will not become dislodged from its receiver while being sawed.

Figure 6:
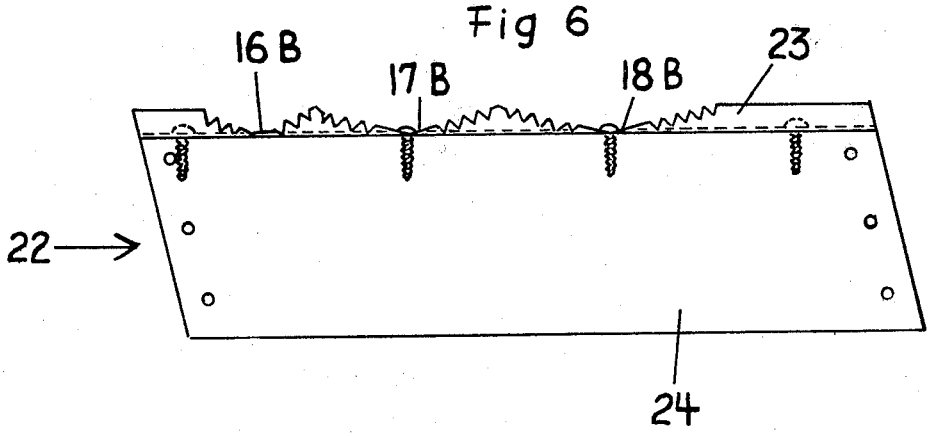
FIG. 6 is another like view of another jaw in which the recesses are formed in a metal strip attached to an edge of a wooden support.

The jaw, generally indicated at 22 illustrated by FIG. 6, has its V-shaped recesses 16B, 17B, and 18B, shown as also of approximately the same dimensions as the V-shaped recesses 16, 17, and 18 are formed in one wall of a length of angle iron 23 with the other wall attached by screws to an edge of a wooden support 24. The recesses 16B, 17B, and 18B are notched to provide anchoring points 21B.

From the foregoing, it will be apparent that sawbucks in accordance with the invention are well adapted for use in cutting cord wood or longer wood into whatever lengths are wanted for stove, heater, or furnace uses and are equally well adapted for simplicity and ease of manufacture and ease of assembly if sold for assembly by the purchaser.

I claim:

1. A sawbuck including an elongated base, upper and lower jaws, means connecting said jaws to one end of said base transversely thereof with said jaws spaced a substantial distance above said base and with the vertical distance between the jaws increasing from a minimum adjacent one side of the base to a maximum adjacent the other side thereof thereby to accommodate ends of logs or split sections thereof within a substantial range of cross sectional sizes and shapes, the upper jaw spaced closer to said one end of the base than the lower jaw whereby when the end of a log or a section thereof that is to extend over the base towards the other end thereof is inserted between the jaws where the vertical dimensions of said end are approximately equal to the vertical spacing of the jaws and then released, said log or sections thereof is held as a cantilever with a substantial unobstructed space between it and said base, and at least one of said jaws including fixed means to hold the thus entered end from moving towards said other side of the base.

2. The sawbuck of claim 1 in which the holding means are a plurality of relatively wide and shallow abutting V-shaped recesses.

3. The sawbuck of claim 1 in which both jaws include holding means and the holding means of both jaws are a plurality of relatively wide and shallow, abutting V-shaped recesses, the corresponding recesses of the two jaws being vertically aligned.

4. The sawbuck of claim 1 in which the connecting means includes a pair of supports, each including first and second uprights interconnected at their upper ends, means connecting said uprights to the base, the lower jaw is connected to the first uprights and the upper jaw is connected to the second uprights.

5. The sawbuck of claim 4 in which the connecting means is reversible and is detachably attached to said base thereby to enable each log or log section to be held as a cantilever in the opposite direction provided the base is counterweighted.

6. The sawbuck of claim 4 and a member secured to the inner surface of an upright below the recesses and protrudes at one side of the connecting means to establish a hanger for a chain saw with the blade thereof between the first and second uprights.

7. The sawbuck of claim 4 in which the jaws are connected to their respective uprights to incline away from each other with a minimum vertical spacing adjacent one support and a maximum vertical spacing adjacent the other support.

8. The sawbuck of claim 7 in which the uprights of each support are inclined towards each other.

9. The sawbuck of claim 7 in which the base includes two side members interconnected adjacent their ends and a bolt detachably connects each of the uprights of each support to the inner surface of each side member of the base.

* * * * *